US012434893B2

(12) United States Patent
Loftin

(10) Patent No.: US 12,434,893 B2
(45) Date of Patent: Oct. 7, 2025

(54) PACKAGE, ARTICLE CARRIER AND BLANK THEREFOR

(71) Applicant: WestRock Shared Services, LLC, Atlanta, GA (US)

(72) Inventor: Caleb S. Loftin, Richmond, VA (US)

(73) Assignee: WestRock Shared Services, LLC, Atlanta, GA (US)

( * ) Notice: Subject to any disclaimer, the term of this patent is extended or adjusted under 35 U.S.C. 154(b) by 58 days.

(21) Appl. No.: 17/802,445

(22) PCT Filed: Feb. 25, 2021

(86) PCT No.: PCT/US2021/019751
§ 371 (c)(1),
(2) Date: Aug. 25, 2022

(87) PCT Pub. No.: WO2021/173890
PCT Pub. Date: Sep. 2, 2021

(65) Prior Publication Data

US 2023/0139409 A1 May 4, 2023

Related U.S. Application Data

(60) Provisional application No. 62/981,215, filed on Feb. 25, 2020.

(51) Int. Cl.
*B65D 77/00* (2006.01)
*B65D 5/30* (2006.01)
(Continued)

(52) U.S. Cl.
CPC ..... *B65D 77/003* (2013.01); *B65D 5/305* (2013.01); *B65D 5/48022* (2013.01); *B65D 75/5833* (2013.01); *B65D 75/5855* (2013.01)

(58) Field of Classification Search
CPC ..... B65D 5/305; B65D 5/48022; B65D 5/48024; B65D 5/48028;
(Continued)

(56) References Cited

U.S. PATENT DOCUMENTS 1,202,986 A * 10/1916 Fogg ..... B65D 5/48032 217/31
1,476,750 A * 12/1923 Casey ..... B65D 5/48 229/122.34
(Continued)

FOREIGN PATENT DOCUMENTS

BE 722153 A 3/1969
EP 3095722 B1 * 2/2019 ..... B65D 25/08
(Continued)

*Primary Examiner* — Chun Hoi Cheung
*Assistant Examiner* — Brijesh V. Patel
(74) *Attorney, Agent, or Firm* — Brian J. Goldberg; Rohini K. Garg

(57) ABSTRACT

Aspects of the disclosure relate to a package, a carrier for packaging one or more articles and a blank (10) for forming the carrier. The package comprises a carrier having a base wall (14, 20, 26; 114, 120, 126), opposed side walls (12, 28; 112, 128) and opposed end walls to define an interior. The carrier may take the form of an open topped tray. The package further comprises a plurality of articles disposed in the interior of the carrier. The package comprises a partition structure (16/18, 22/24; 116/118, 122/124) dividing the interior into two or more chambers (C1/C2, C2/C3). The partition structure (16/18, 22/24; 116/118, 122/124) may comprise an opening or portal providing a passageway between two adjacently disposed chambers. The opening may be defined or controlled, at least in part by, a gate panel (116B, 24B; 116B, 124B).

18 Claims, 6 Drawing Sheets

(51) Int. Cl.
*B65D 5/4805* (2006.01)
*B65D 75/58* (2006.01)

(58) Field of Classification Search
CPC ..... B65D 5/48032–48034; B65D 5/48048; B65D 5/24–242; B65D 75/5833; B65D 75/5855; B65D 2585/366
USPC ..... 206/525, 561, 589, 588; 229/120.06, 229/120.15, 120.24, 120.37–120.38
See application file for complete search history.

(56) References Cited

U.S. PATENT DOCUMENTS 1,808,922 A * 6/1931 Gallistel ..... B65D 5/48018 229/190
1,913,655 A * 6/1933 Benoit ..... B65D 85/328 229/120.32
2,102,009 A * 12/1937 Kondolf ..... B65D 5/28 229/120.16
2,235,800 A * 3/1941 Columba ..... B65D 5/4801 229/104
2,445,202 A * 7/1948 Belanger ..... B65D 71/0022 206/140
2,620,962 A * 12/1952 Powell ..... B65D 5/5021 206/443
2,804,252 A * 8/1957 Nute ..... B65D 5/4295 229/120.36
2,827,221 A * 3/1958 Vines ..... B65D 5/5016 206/591
2,934,252 A * 4/1960 Wickstrom ..... B65D 25/04 229/185
3,069,008 A * 12/1962 Dugre ..... B65D 5/48014 206/422
3,138,256 A * 6/1964 Miessler, Sr. ..... B65D 5/5016 206/422
3,166,228 A * 1/1965 Weiss ..... B65D 71/16 206/196
3,326,444 A * 6/1967 Farquhar ..... B65D 5/48006 229/120.18
3,347,356 A * 10/1967 Kossnar ..... B65D 5/524 229/164
3,414,182 A * 12/1968 Fobiano ..... B65D 5/4802 229/164
3,531,042 A * 9/1970 Atkinson ..... B65D 5/48048 229/117.22
3,578,235 A * 5/1971 Weiss ..... B65D 1/36 229/120.07
3,610,511 A * 10/1971 Engdahl, Jr. ..... B65D 71/0077 206/198
3,822,785 A * 7/1974 Getz ..... B65D 5/5016 206/422
3,829,003 A * 8/1974 Dilot ..... B65D 5/2019 206/219
3,876,132 A * 4/1975 Kuchenbecker ... B65D 5/48022 229/120.17
3,889,867 A * 6/1975 Berg ..... B65D 5/3621 229/122
3,917,105 A * 11/1975 Lambert ..... B42F 17/02 229/120.24
3,968,924 A * 7/1976 Tyrseck ..... B65D 5/5016 206/418
4,081,125 A * 3/1978 Meyers ..... B65D 25/04 229/114
4,089,458 A * 5/1978 Meyers ..... B65D 5/48 229/120.16
4,108,348 A * 8/1978 Partain ..... B65D 5/48014 229/120.29
4,114,796 A * 9/1978 Voges ..... B65D 5/4802 229/120.15
4,146,127 A * 3/1979 Bayer ..... B65D 85/187 206/294
4,159,609 A 7/1979 Focke
4,177,715 A * 12/1979 Meyers ..... B65D 25/04 493/90
4,185,766 A * 1/1980 Davidson ..... B65D 5/5061 206/422
4,197,979 A * 4/1980 Dutcher ..... B65D 5/48004 229/164
4,202,465 A * 5/1980 McLaren ..... B65D 5/48022 229/905
4,219,148 A * 8/1980 Garmon ..... B65D 5/58 229/120.14
4,243,138 A * 1/1981 Wilson ..... B65D 71/0077 206/188
4,294,359 A * 10/1981 Berkel ..... B65D 5/5073 229/120.35
4,301,960 A * 11/1981 Alexander ..... B65D 77/0406 383/66
4,371,366 A * 2/1983 Bower ..... B65D 5/4802 493/90
4,376,508 A * 3/1983 Gardner ..... B65D 5/48008 229/120.24
4,396,146 A * 8/1983 Sieffert ..... B65D 5/3635 229/117.06
4,403,727 A * 9/1983 Grieve ..... B65D 5/4802 229/164
4,438,848 A * 3/1984 Montealegre ..... B65D 5/5021 206/476
4,848,648 A * 7/1989 Eisman ..... B65D 5/48 229/148
4,905,889 A * 3/1990 Schuster ..... B65D 5/48022 206/561
4,944,451 A * 7/1990 Forbes, Jr. ..... B65D 5/48022 229/114
5,009,363 A * 4/1991 Zavatone ..... B65D 5/48022 229/120.16
5,335,845 A * 8/1994 Liu ..... B65D 5/48018 229/117.07
5,464,149 A * 11/1995 Fowler ..... B65D 5/48048 229/120.38
5,588,583 A * 12/1996 Cargile, Jr. ..... B65D 5/48022 229/190
5,657,925 A * 8/1997 Norris ..... B65D 5/48016 229/120.13
5,752,605 A * 5/1998 Cooper ..... B65D 5/504 206/589
5,775,496 A * 7/1998 Cyr ..... A45C 13/02 220/531
5,855,315 A * 1/1999 Roseth ..... B65D 5/5495 229/120.04
5,908,152 A * 6/1999 Tullis ..... B65D 5/48022 229/148
5,909,840 A * 6/1999 Schultheiss ..... B65D 5/48018 229/172
5,967,406 A * 10/1999 Moorman ..... B65D 5/324 206/427
5,979,747 A * 11/1999 Gnadt ..... B65D 71/0014 229/117.14
6,471,121 B1 * 10/2002 Nielsen ..... B65D 5/48022 229/120.16
6,789,678 B2 * 9/2004 Auclair ..... B65D 5/5016 206/277
7,357,253 B2 * 4/2008 Scott ..... B65D 85/42 206/419
7,994,456 B2 * 8/2011 Ford ..... A47J 37/08 219/730
8,875,984 B2 * 11/2014 Leidal ..... B65D 5/48034 229/199
9,776,760 B2 * 10/2017 Keeder ..... B31B 50/81
10,106,291 B2 * 10/2018 Kearns ..... B65D 5/4204
2004/0211822 A1 * 10/2004 Lin ..... B65D 5/48018 206/299
2011/0253587 A1 * 10/2011 Pinkstone ..... B65D 5/6667 493/90
2011/0290796 A1 * 12/2011 Burgess ..... B65D 21/04 220/552
2011/0303738 A1 * 12/2011 Foushee ..... B65D 5/48022 493/127

(56) References Cited

U.S. PATENT DOCUMENTS

| | | | | |
|---|---|---|---|---|
| 2014/0217102 | A1* | 8/2014 | Wilson | B65D 5/443<br>220/501 |
| 2014/0263353 | A1* | 9/2014 | Bell | B65D 5/4295<br>229/148 |
| 2019/0248538 | A1* | 8/2019 | Goretti | B65D 5/48048 |
| 2021/0284381 | A1* | 9/2021 | Valencia | B65D 5/2057 |
| 2022/0185532 | A1* | 6/2022 | Valencia | B65D 5/48022 |

FOREIGN PATENT DOCUMENTS

| | | | | |
|---|---|---|---|---|
| EP | 3524532 | A1 | | 8/2019 |
| FR | 3016349 | A1 | | 7/2015 |
| GB | 1327641 | A | | 8/1973 |
| GB | 2115384 | A1 | | 9/1983 |
| JP | H10310127 | A | * | 11/1998 |
| JP | 2000006955 | A | * | 1/2000 |
| JP | 3817800 | B2 | * | 9/2006 |
| JP | 2011207482 | A | * | 10/2011 |
| JP | 2014094772 | A | * | 5/2014 |
| JP | 3193465 | U | * | 10/2014 |
| JP | 2020132184 | A | * | 8/2020 |

* cited by examiner

PACKAGE, ARTICLE CARRIER AND BLANK THEREFOR

CROSS REFERENCE TO RELATED APPLICATION

This application claims the benefit of U.S. Provisional Patent Application No. 62/981,215 filed Feb. 25, 2020, the disclosure of which is herein incorporated by reference in its entirety.

TECHNICAL FIELD

The present invention relates to article carriers and to blanks for forming the same. More specifically, but not exclusively, the invention relates to a tray for receiving a foodstuff.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide a package comprising a film sealed bag in which a tray loaded with a foodstuff is disposed. It is an object of the present disclosure to improve the accessibility of the foodstuff.

The present invention seeks to provide an improvement in the field of packages, typically formed from paperboard or the like.

SUMMARY

A first aspect of the invention provides a package comprising a film sealed bag and a carrier disposed within the film sealed bag. The carrier has an interior defined, at least in part, by a base wall, opposed side walls and opposed end walls. The package comprises a plurality of articles disposed in the interior of the carrier. The carrier comprises a partition structure dividing the carrier into two or more chambers. The partition structure may comprise a portal forming a passage way between two adjacently disposed chambers for allowing articles in one of the chambers to pass into the other of the chambers.

Optionally, the film sealed bag comprises an access opening defined at least in part by a tear panel the access opening being arranged to fully expose at least one article disposed in one of the chambers.

Optionally, at least one article in the other of the chambers is at least partially obscured by a portion of the film sealed bag adjacent to the tear panel.

A second aspect of the invention provides a carrier for a package. The carrier has an interior defined, at least in part, by a base wall, opposed side walls and opposed end walls. The carrier comprises a plurality of articles disposed in the interior. The carrier comprises a partition structure dividing the carrier into two or more chambers. The partition structure may comprise a portal forming a passage way between two adjacently disposed chambers for allowing articles in one of the chambers to pass into the other of the chambers.

Optionally, the carrier comprises at least one gate panel translatable or transformable between a first position closing the portal in the partition structure and a second position opening the portal in the partition structure.

Optionally, the base wall of the carrier comprises a first base panel and a second base panel.

Optionally, the first base panel is coupled to the second base panel by the partition structure.

Optionally, the first base panel is spaced apart from the second base panel.

Optionally, the at least one gate panel spans a gap between the first base panel and the second base panel when in the second position.

Optionally, the at least one gate panel is hingedly connected to one of the first and second base panels.

Optionally, the partition structure comprises at least two divider panels.

Optionally, a cutaway is struck from the at least two divider panels to form the portal.

Optionally, a gate panel is struck from at least one of the at least two divider panels.

Optionally, the partition structure comprises a first divider panel hingedly connected to a second divider panel.

Optionally, the partition structure comprises two or more divider panels interconnecting the first base panel and the second base panel.

A third aspect of the invention provides a carrier for receiving one or more articles. The carrier comprises a plurality of panels forming walls thereof. The walls define an interior, the interior being defined, at least in part, by a base wall, opposed side walls, and opposed end walls. The carrier comprises a partition structure dividing the carrier into two or more chambers. The partition structure may comprise a portal forming a passage way between two adjacently disposed chambers.

A fourth aspect of the invention provides a carrier having an interior for receiving one or more articles. The carrier comprises a plurality of wall forming panels. The plurality of wall forming panels includes a first base panel and a second base panel coupled to the first base panel by at least two foldably connected divider panels. A first end panel is hingedly connected to the first base panel and a second end panel is hingedly connected to the second base panel. The second end panel is secured to the first end panel in at least partial overlapping relationship. The at least two foldably connected divider panels are disposed in face to face relationship to divide the interior into two chambers.

Optionally, the first and second base panels are spaced apart from each other by a gap.

Optionally, a gate panel is struck from the at least two foldably connected divider panels.

Optionally, the gate panel is hingedly connected to one of the first and the second base panels.

Optionally, the gate panel defines at least in part a portal between the two chambers and is foldable between a first position closing the portal and a second position opening the portal.

Optionally, the gate panel spans the gap between the first and second base panels when in the second position.

Optionally, the carrier further comprises a first side panel and a second side panel to define a tray.

Optionally, the first end panel comprises a first part of a complementary locking mechanism and the second end panel comprises a second part of the complementary locking mechanism for receiving at least a portion of the first part.

Optionally, the first part comprises a pair of end stops limiting movement between the first and second parts in a locked condition.

Optionally, one of the end stops defines, at least in part, the spacing between the first and second base panels.

Optionally, the first and second base panels are spaced apart such that the at least two foldably connected divider panels are divergently arranged with respect to each other.

Optionally, the at least two foldably connected divider panels comprises two divider panels hingedly connected to each other to define an inverted "V" shape.

Optionally, the at least two foldably connected divider panels diverge towards the first and second base panels.

Optionally, the carrier further comprises a third base panel coupled to the second base panel by at least two foldably connected second divider panels and a third end panel hingedly connected to the third base panel, the third end panel is secured to the second end panel in at least partial overlapping relationship such that the at least two foldably connected second divider panels are disposed in face to face relationship and divide the interior to define, at least in part, a third chamber.

Optionally, the third end panel comprises a third part of the complementary locking mechanism receivable in the second part of the complementary locking mechanism provided by the second end panel.

A fifth aspect of the invention provides a blank for forming a carrier. The blank comprises a plurality of panels for forming walls of the carrier. The plurality of panels includes at least one base panel, first and second side panels, at least one first end panel for forming a first end wall of the carrier and at least one second end panel for forming a second end wall of the carrier. The blank comprises at least one divider panel for forming a partition structure dividing the carrier, in a set up condition, into two or more chambers. The at least one divider panel may comprise a cutaway for forming a portal in the set up carrier to provide a passage way between two adjacently disposed chambers.

Optionally, the cutaway comprises a feature selected from the group consisting of a cut line, severance line, aperture, slot and slit.

Optionally, the cutaway defines, at least in part, a gate panel.

Optionally, at least one base panel comprises a first base panel and a second base panel and the gate panel is hingedly connected to one of the first and second base panels.

A sixth aspect of the invention provides a blank for forming a carrier. The blank comprises a plurality of panels for forming walls of the carrier. The plurality of panels includes a first base panel and a second base panel coupled to the first base panel by at least two foldably connected divider panels. A first end panel is hingedly connected to the first base panel. A second end panel is hingedly connected to the second base panel and configured to be securable to the first end panel in at least partial overlapping relationship in a set up carrier. The at least two foldably connected divider panels are foldable into a face to face relationship to divide an interior of a setup carrier into two chambers.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
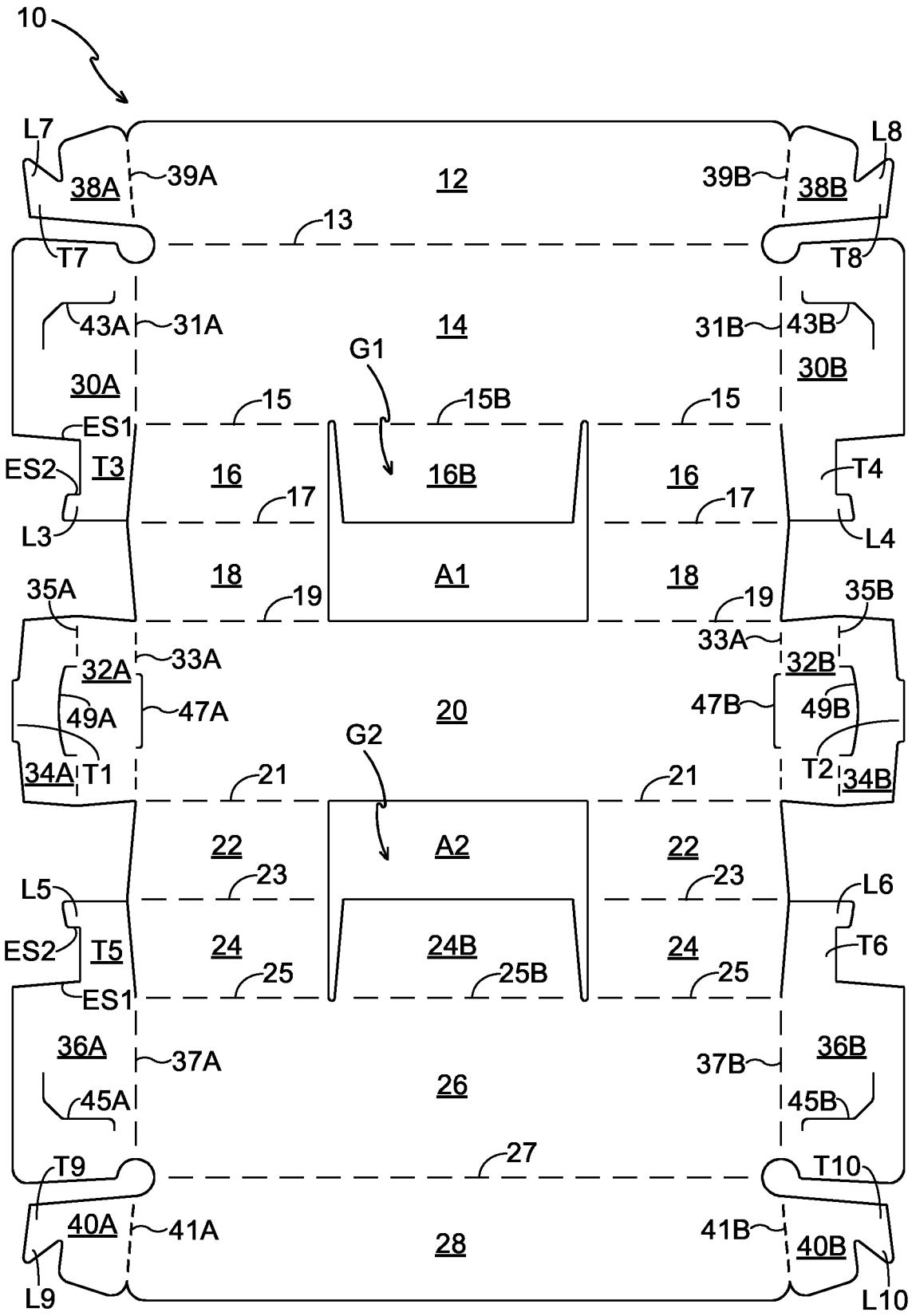
FIG. 1 is a plan view from above of a blank for forming a carrier or tray according to a first embodiment.
Figure 2:
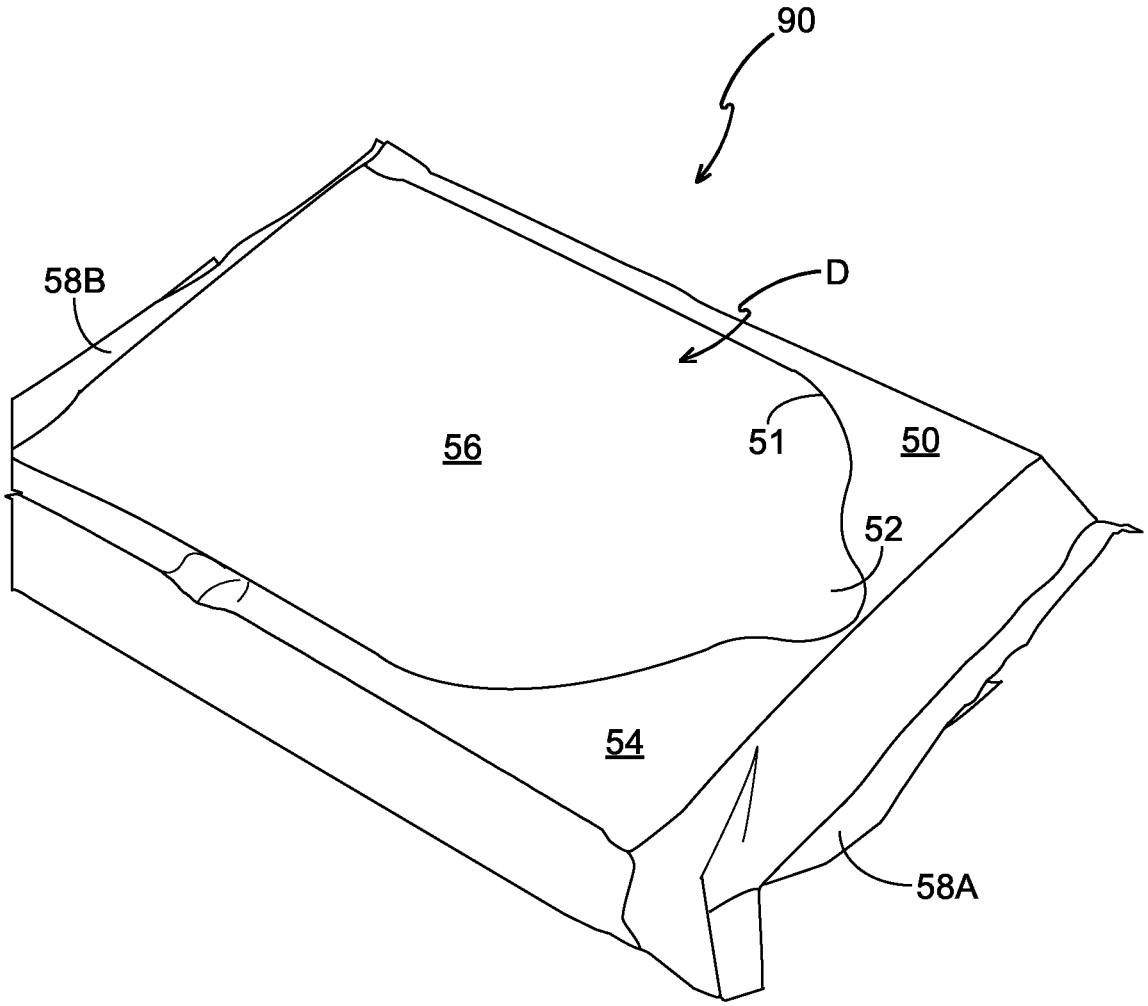
FIG. 2 is a perspective view from above of a package comprising a film sealed bag and a tray formed from the blank of FIG. 1.
Figure 3:
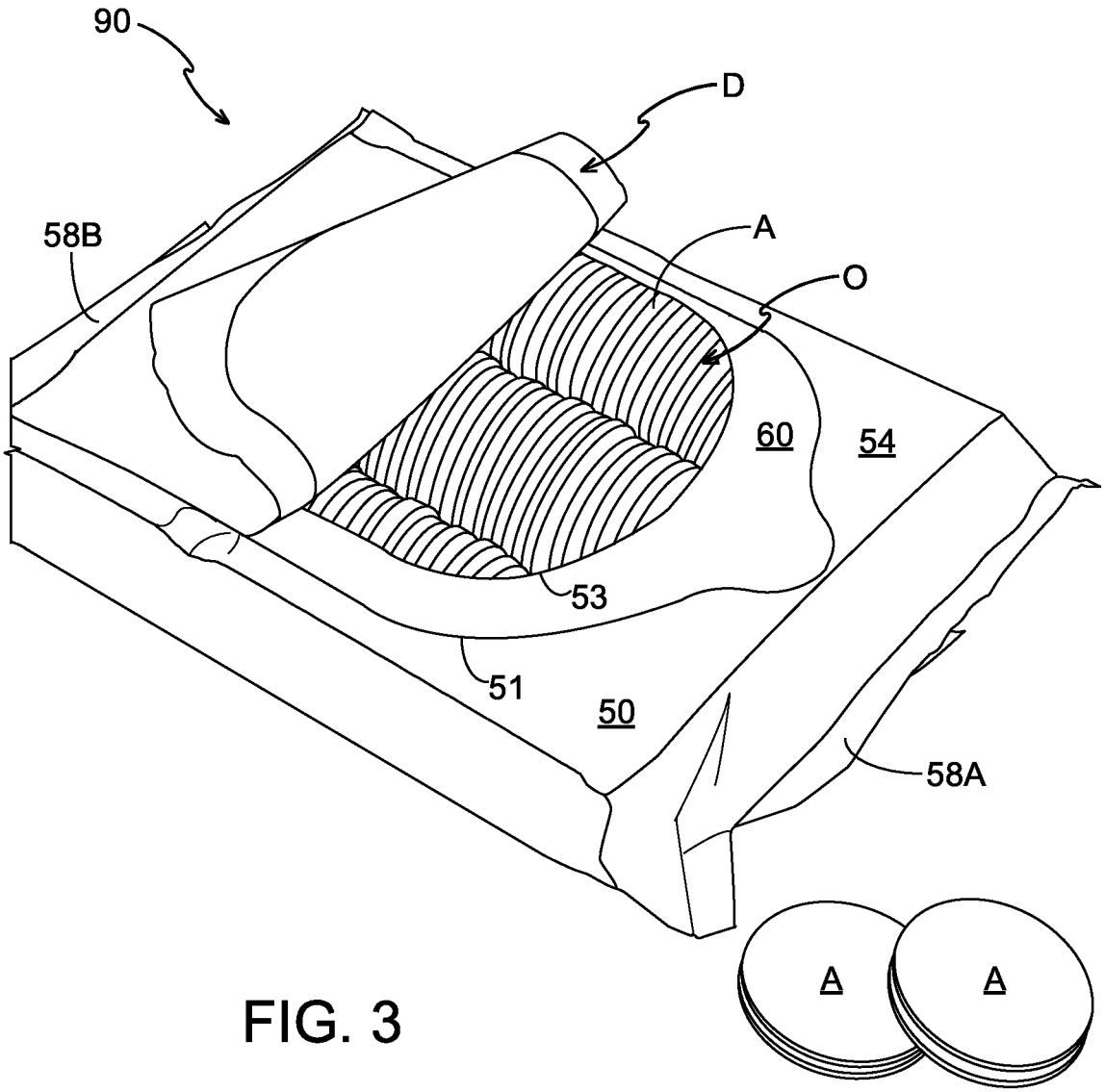
FIG. 3 is a perspective view from above of the package of FIG. 1 in which an access device or dispenser has been deployed.
Figure 4:
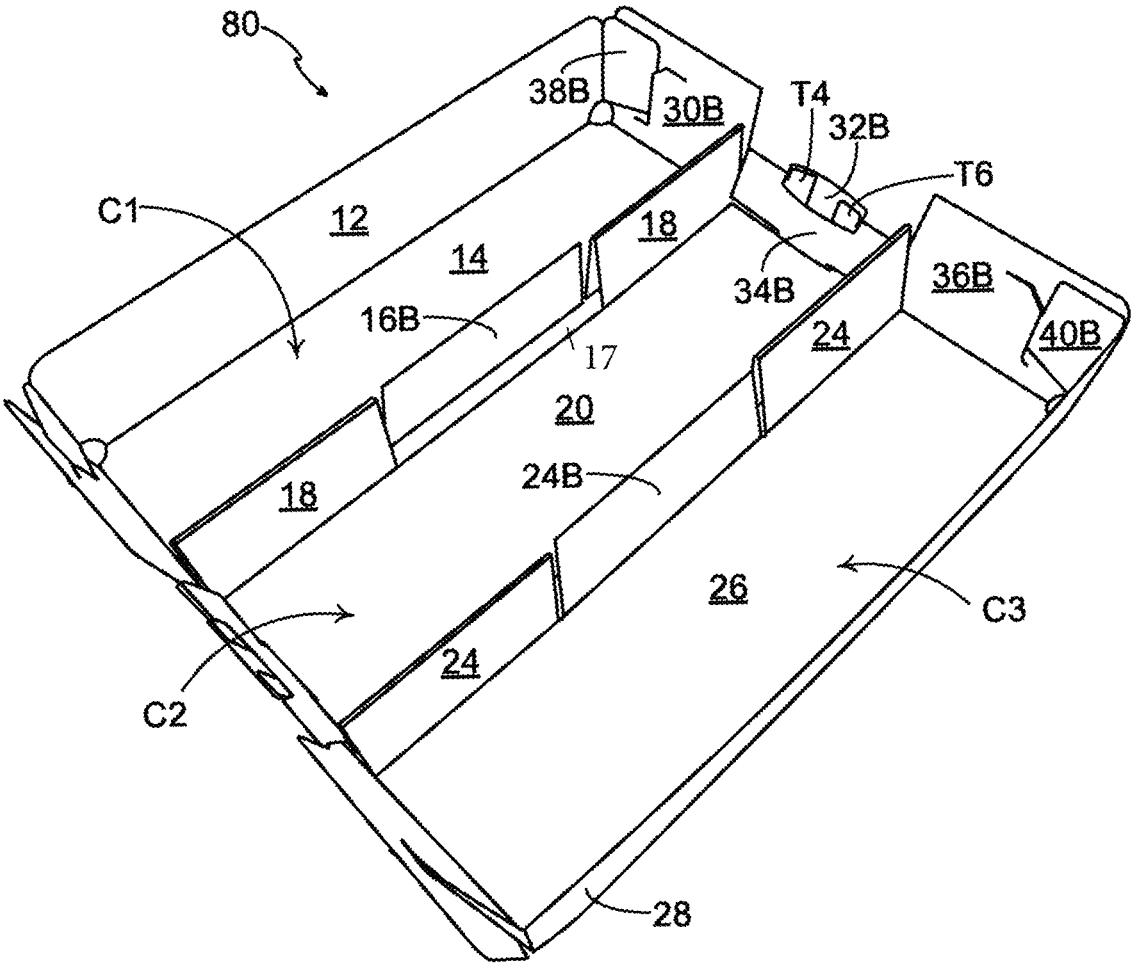
FIG. 4 is a perspective view from above of a tray formed from the blank of FIG. 1 in a first condition.
Figure 6:
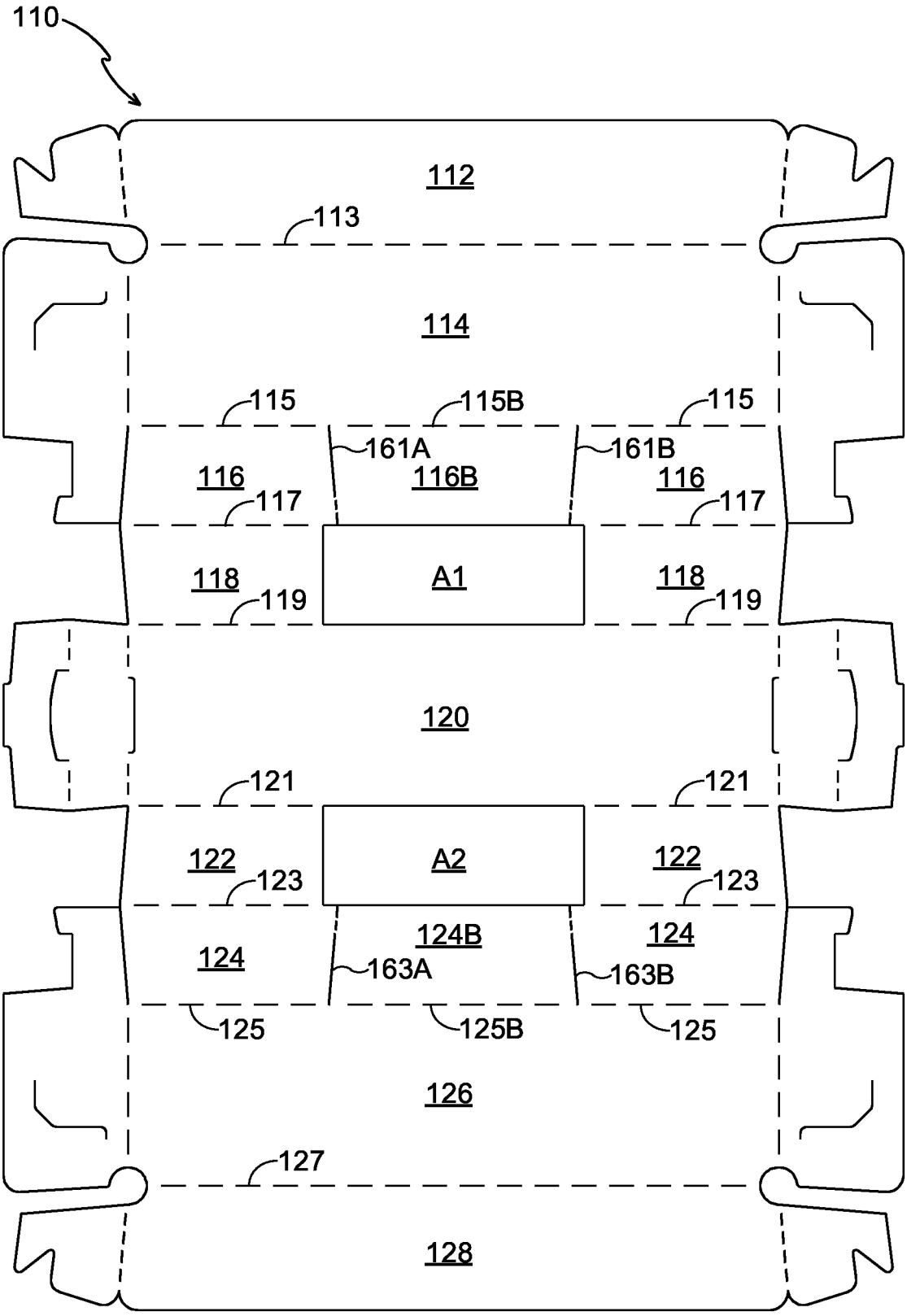
FIG. 6 is a plan view from above of a blank for forming a carrier or tray according to a second embodiment.

Referring to FIG. 1, there is shown a plan view of a blank 10 which is capable of forming a tray or carrier 80, as shown in FIG. 4, for containing and carrying a group of primary products such as, but not limited to, cookies or biscuits, hereinafter referred to as articles B, as shown in FIG. 2. The tray 80 forms part of a package 90 also including a film sealed bag 50 as shown in FIGS. 2 and 3. An alternative blank 110 for forming an alternative tray is shown in FIG. 6.

The blanks 10; 110 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

Referring to FIG. 1 there is shown a blank 10 comprising a plurality of panels 12, 14, 16, 18, 20, 22, 24, 26, 28. The plurality of panels 12, 14, 16, 18, 20, 22, 24, 26, 28 may be arranged in a linear series hinged one to the next by corresponding fold lines 13, 15, 17, 19, 21, 23, 25, 27. The plurality of panels 12, 14, 16, 18, 20, 22, 24, 26, 28 includes a first side panel 12 hingedly connected to a first base panel 14 by a hinged connection in the form of a fold line 13. The first base panel 14 is hingedly connected to a first divider or partition panel 16 by a hinged connection in the form of a fold line 15. The first divider panel 16 is hingedly connected to a second divider panel 18 by a hinged connection in the form of a fold line 17. The second divider panel 18 is hingedly connected to a second base panel 20 by a hinged connection in the form of a fold line 19. The second base panel 20 is hingedly connected to a third divider or partition panel 22 by a hinged connection in the form of a fold line 21. The third divider panel 22 is hingedly connected to a fourth divider or partition panel 24 by a hinged connection in the form of a fold line 23. The fourth divider panel 24 is hingedly connected to a third base panel 26 by a hinged connection in the form of a fold line 25. The third base panel 26 is hingedly connected to a second side panel 28 by a hinged connection in the form of a fold line 27.

The plurality of panels 12, 14, 16, 18, 20, 22, 24, 26, 28 form at least one trough C1, C2, C3 for receiving an article B. The illustrated embodiment comprises three troughs C1, C2, C3. In other embodiments two troughs may be provided or more than three troughs may be provided. The first divider panel 16 and the second divider panel 18 provide a first partition extending longitudinally across the tray 80.

The third divider panel 22 and the fourth divider panel 24 provide a second partition extending longitudinally across the tray 80.

The first side panel 12 and first divider panel 16 define, at least in part, a first trough or chamber C1.

The second divider panel 18 and third divider panel 22 define, at least in part, a second trough or chamber C2.

The second side panel 28 and fourth divider panel 24 define, at least in part, a third trough or chamber C3.

The blank 10 comprises a plurality of end flaps or panels for closing ends of the troughs or chambers C1, C2, C3. The end flaps may also serve to secure the blank 10 in an erected form. In the illustrated embodiment the blank 10 comprises a mechanical locking device for securing the tray 80 in an erected condition. In other embodiments the tray 80 may be secured with other mechanical devices such as, but not limited to, staples or with glue or other adhesive treatment.

The blank 10 comprises a first plurality of end closure flaps 38A, 30A, 32A, 34A, 36A, 40A hinged to a first end edge of the blank 10 and a second plurality of end closure flaps 38B, 30B, 32B, 34B, 36B, 40B hinged to a second, opposing, end edge of the blank 10.

The first plurality of end closure flaps 38A, 30A, 32A, 34A, 36A, 40A are arranged to close an end of the tray 80 at a first end thereof.

A first side end closure flap 38A is hingedly connected to a first end of the first side panel 12 by a hinged connection in the form of a fold line 39A.

A first base end closure flap 30A is hingedly connected to a first end of the first base panel 14 by a hinged connection in the form of a fold line 31A.

A second base end closure flap 32A is hingedly connected to a first end of the second base panel 20 by a hinged connection in the form of a fold line 33A. A first securing flap 34A is hingedly connected to a first end edge of the second base end closure flap 32A by a hinged connection in the form of a fold line 35A. The first end edge of the second base end closure flap 32A opposes a second end edge of the second base end closure flap 32A at which second end edge the second base end closure flap 32A is hinged to the second base panel 20.

A third base end closure flap 36A is hingedly connected to a first end of the third base panel 26 by a hinged connection in the form of a fold line 37A.

A second side end closure flap 40A is hingedly connected to a first end of the second side panel 28 by a hinged connection in the form of a fold line 41A.

The second plurality of end closure flaps 38B, 30B, 32B, 34B, 36B, 40B are arranged to close an end of the tray 80 at a second end thereof.

A third side end closure flap 38B is hingedly connected to a second end of the first side panel 12 by a hinged connection in the form of a fold line 39B.

A fourth base end closure flap 30B is hingedly connected to a second end of the first base panel 14 by a hinged connection in the form of a fold line 31B.

A fifth base end closure flap 32B is hingedly connected to a second end of the second base panel 20 by a hinged connection in the form of a fold line 33B. A second securing flap 34B is hingedly connected to a first end edge of the fifth base end closure flap 32B by a hinged connection in the form of a fold line 35B. The first end edge of the fifth base end closure flap 32B opposes a second end edge of the fifth base end closure flap 32B at which second end edge the fifth base end closure flap 32B is hinged to the second base panel 20.

A sixth base end closure flap 36B is hingedly connected to a second end of the third base panel 26 by a hinged connection in the form of a fold line 37B.

A fourth side end closure flap 40B is hingedly connected to a second end of the second side panel 28 by a hinged connection in the form of a fold line 41B.

The blank 10 may comprise one or more locks for securing the end closure flaps together in an erected state.

Each of the first, second, third and fourth side end closure flap 38A, 40A, 38B, 40B comprises a first or male part T7, T9, T8, T10 of a first complementary locking device having a latch or shoulder L7, L9, L8, L10. Each of the first, third, fifth and sixth base end closure flap 30A, 36A, 30B, 36B comprises a second or female part 43A, 45A, 43B, 45B of the first complementary locking device.

Each of the first complementary locking devices are substantially similar in construction and will be described with in more detail with reference to the first complementary locking device provided by the first side end closure flap 38A and the first base end closure flap 30A.

The first side end closure flap 38A comprises a tab or projection T7 which forms the first part of a first complementary locking device. The tab T7 is defined in part by a cutaway or recess struck from the first side end closure flap 38A so as to define a latch or shoulder L7.

The first base end closure flap 30A comprises a cutaway which forms the second part of a first complementary locking device and may take the form of a cutline 43A. The cutaway forms a receiver or keeper for receiving the tab T7. The cutline 43A provides an opening into which the tab T7 is inserted. The cutline 43A may be non-linear, it may comprise two or more linear portions divergently arranged with respect to each other. In the illustrated embodiment the cutline 43A comprises a first portion and a second portion oriented substantially perpendicular to the first portion. A third portion may couple the first portion to the second portion, the third portion being divergently arranged with respect to the first portion and to the second portion. A fourth portion may extend form the first portion, the fourth portion may be substantially perpendicular to the first portion. In the illustrated embodiment the cutline 43A may be substantially "L" shaped. The cutline 43A may be substantially "S" or "Z" shaped.

In a setup condition the shoulder or latch L7 provided by the first side end closure flap 38A may engage with a portion of the first base end closure flap 30A, said portion may be defined in part by the cutline 43A, in the illustrated embodiment the shoulder or latch L7 engages with a portion of the first base end closure flap 30A defined, at least in part, by the third portion of the cutline 43A.

Each of the first, third, fifth and sixth base end closure flap 30A, 36A, 30B, 36B comprises a first or male part of a respective second complementary locking device.

The second base end closure flap 32A and the first securing flap 34A provide a second or female part of the second complementary locking device for securing the first and third base end closure flaps 30A, 36A in an erected condition.

The fifth base end closure flap 32B and the second securing flap 34B provide a second or female part of the second complementary locking device for securing the fifth and sixth base end closure flaps 30B, 36B in an erected condition.

The second complementary locking device will be described in further detail with reference to second base end closure flap 32A, the first securing flap 34A and the first and third base end closure flaps 30A, 36A.

The first base end closure flap 30A comprises a tab or projection T3 which forms the first part of a second complementary locking device. The tab T3 extends from a side edge of the first base end closure flap 30A, the tab T3 is provided from material disposed adjacent to a first end edge of the first divider panel 16. The tab T3 is integral with first base end closure flap 30A. A cutaway in the form of a recess is struck from an end edge of the first base end closure flap 30A so as to define, at least in part, a latch or shoulder L3.

The third base end closure flap 36A comprises a tab or projection T5 which forms the first part of a second complementary locking device. The tab T5 extends from a side edge of the third base end closure flap 36A, the tab T5 is provided from material disposed adjacent to a first end edge of the fourth divider panel 24. The tab T5 is integral with third base end closure flap 36A. A cutaway in the form of a recess is struck from an end edge of the third base end closure flap 36A so as to define, at least in part, a latch or shoulder L5.

The second base end closure flap 32A comprises a cutaway in the form of a cutline 49A. The cutline 49A may be substantially "U" shaped. The cutline 49A interrupts the hinged connection between the second base end closure flap 32A and the first securing flap 34A so as to form a first and second hinge portion spaced apart from each other. The cutaway partially separates second base end closure flap 32A from the first securing flap 34A. When the first securing flap 34A is folded about fold line 35A into face to face relationship with the second base end closure flap 32A an opening is formed. The opening provides a receiver. The opening receives a portion of each of the tabs T3, T5 of the first and third base end closure flaps 30A, 36A. The latches or shoulders L3, L5 engage with a portion of the second base end closure flap 32A. The cutline 49A may provide or define, at least in part, a projection integral with the second base end closure flap 32A and extending therefrom, the projection may protect or reinforce the latches or shoulders L3, L5 when engaged within the opening. The projection is formed form material which would otherwise form part of the first securing flap 34A.

The first securing flap 34A comprises tongue T1 extending from a free end edge, the free end edge opposes a hinged edge defined in part by the hinged connection between first securing flap 34A and the second base end closure flap 32A. The tongue T1 forms first or male part of a third complementary locking device. The tongue T1 engages with a second or female part of the third complementary locking device. The second part of the third complementary locking device is provided by an opening between the second base end closure flap 32A and the second base panel 20. The opening may be formed by a cutaway in the form of a cutline 47A, the cutline 47A may be substantially "U" shaped and interrupts the hinged connection between the second base end closure flap 32A and the second base panel 20. The cutline 49A may provide or define, at least in part, a second projection integral with the second base end closure flap 32A and extending therefrom, the second projection may protect or reinforce the tongue T1 when engaged within the opening. The second projection is formed from material which would otherwise form part of the second base panel 20.

In an erected condition the tabs T3, T5, or at least portions thereof, are disposed or sandwiched between the first securing flap 34A and the second base end closure flap 32A.

The third complementary locking device secures the first securing flap 34A and the second base end closure flap 32A in a folded condition.

A first portion of the fold line 49A is received in the recess struck from the free end edge of the tab T3 of the first base end closure flap 30A.

A second portion of the fold line 49A is received in the recess struck from the free end edge of the tab T5 of the third base end closure flap 36A.

The recesses in each of the first and third base end closure flap 30A, 36A each provide a first end stop ES1 and a second end stop ES2. The first end stop ES1 prevents or inhibits movement of the first and third base end closure flap 30A, 36A in a first direction. The second end stop ES2 prevents or inhibits movement of the first and third base end closure flap 30A, 36A in a second, opposing direction. In this way, in an erected tray 80 the first base panel 14 is secured in an erected position relative to the second base panel 20. The third base panel 26 is similarly secured in an erected position relative to the second base panel 20.

In the illustrated embodiment the first base panel 14 is arranged to be spaced apart from and parallel to the second base panel 20. The third base panel 26 is arranged to be spaced apart from and parallel to the second base panel 20. The position of the first end stop ES1 relative to the fold line defines at least in part the spacing between first or third base panel 14, 26 and the second base panel 20. In the illustrated embodiment, the second base panel 32A comprises a pair of opposed side edges. Each of the pair of opposed side edges may be non collinear with respect to one of the fold lines 19, 21. In this way a lateral offset is provided, the lateral offset, when present, defines at least in part the spacing between first or third base panel 14, 26 and the second base panel 20.

The second end stop ES2 prevents or inhibits separation of the first or third base panel 14, 26 from the second base panel 20, and therefore prevents or inhibits unfolding of a divider structure described in more detail below.

The first, second, third and fourth divider panel 16, 18, 22, 24 comprise opposed free end edges. The free end edges are non-collinear with respect to the end edges of the first, second and third base panels 14, 20, 26.

Each of the free end edges of the first divider panel 16 may be arranged divergently with respect to the first or second end of the first base panel 14.

Each of the free end edges of the second divider panel 18 may be arranged divergently with respect to the first or second end of the second base panel 20.

Each of the free end edges of the third divider panel 22 may be arranged divergently with respect to the first or second end of the second base panel 20.

Each of the free end edges of the fourth divider panel 24 may be arranged divergently with respect to the first or second end of the third base panel 26.

A first free end edge of the first divider panel 16 may be divergently arranged with respect to a first free end edge of the second divider panel 18. A second free end edge of the first divider panel 16 may be divergently arranged with respect to a second free end edge of the second divider panel 18.

A first free end edge of the third divider panel 22 may be divergently arranged with respect to a first free end edge of the fourth divider panel 24. A second free end edge of the third divider panel 22 may be divergently arranged with respect to a second free end edge of the fourth divider panel 24.

The first free end edges of the divider panels 16, 18, 22, 24 are longitudinally offset (at least in part) with respect to the first end edges of the first, second and third base panels 14, 20, 26. The second free end edges of the divider panels 16, 18, 22, 24 are longitudinally offset (at least in part) with respect to the second end edges of the first, second and third base panels 14, 20, 26. This offset limits or defines the extent to which the end closure flaps 38A, 30A, 32A, 34A, 36A, 40A, 38B, 30B, 32B, 34B, 36B, 40B can be folded with respect to the base panels 14, 20, 26. The offset can be considered to limit or define an angle through which the end closure flaps 38A, 30A, 32A, 34A, 36A, 40A, 38B, 30B, 32B, 34B, 36B, 40B can be folded with respect to the base panels 14, 20, 26. In the illustrated embodiment the end closure flaps 38A, 30A, 32A, 34A, 36A, 40A, 38B, 30B, 32B, 34B, 36B, 40B are inclined with respect to base panels 14, 20, 26. The end closure flaps 38A, 30A, 32A, 34A, 36A, 40A, 38B, 30B, 32B, 34B, 36B, 40B and the base panels 14, 20, 26 define and angle therebetween, in the illustrated embodiment the angle is greater than 90°. The angle may be in the range 90°-120°, it may be in the range 90°-110° and in some embodiments may be around 95°.

The fold lines 38A, 39B may be obliquely oriented with respect to fold line 13, the fold lines 41A, 41B may be obliquely oriented with respect to fold line 27 in order that the end walls formed from the first plurality of end closure flaps 38A, 30A, 32A, 34A, 36A, 40A and the second plurality of end closure flaps 38B, 30B, 32B, 34B, 36B, 40B are inclined with respect to the base wall formed by the first, second and third base panel 14, 20, 26. In this way first and second end walls are divergently arranged with respect to each other in a set up condition.

Side edges of the first, third, fifth and sixth base end closure flaps 30A, 36A, 30B, 36B which oppose the side edges from which the tabs T3, T5, T4, T6 extend may be non-collinear with respect to fold line 13 or fold line 27 and may be divergently arranged thereto. In this way the angle through which the first and second side panel 12, 28 can be folded with respect to the base panels 14, 20, 26 is limited. The first side panel 12 is arranged to be inclined or obliquely oriented with respect to the first base panel 14. The second side panel 28 is arranged to be inclined or obliquely oriented with respect to the third base panel 26. In this way the first and second side panel 12, 28 are divergently arranged with respect to each other in a set up condition.

The blank 10 may comprise a gate or door in each of the partition structures. The first and second divider panels 16, 18 form a first partition structure and may comprise a first gate G1.

The third and fourth divider panels 22, 24 form a second partition structure and may comprise a second gate G2.

The first gate G1 comprises an opening and a first gate panel 16B struck from the first divider panel 16 and hinged to the first base panel 14 by hinged connection in the form of fold line 15B. Fold line 15B is collinear with fold line 15 hinging the first divider panel 16 to the first base panel 14. The first gate panel 16B is defined in part by a cutaway in the form of at least one aperture A1. Aperture A1 defines opposed side edges of the first gate panel 16B. The aperture A1 may also define a free end edge, the free end edge opposes a hinged edge defined by fold line 15B. The aperture A1 extends into the second divider panel 18. The portion of the aperture A1 struck from the second divider panel 18 is dimensioned to accommodate or receive the first gate panel 16B in an open condition. In this way the first gate panel 16B acts like a draw bridge spanning or crossing a space or gap 17 between the first and second base panels 14, 20.

The second gate G2 comprises an opening and a second gate panel 24B struck from the fourth divider panel 24 and hinged to the third base panel 26 by hinged connection in the form of fold line 25B. Fold line 25B is collinear with fold line 24 hinging the fourth divider panel 24 to the third base panel 24. The second gate panel 24B is defined in part by a cutaway in the form of at least one aperture A2. Aperture A2 defines opposed side edges of the second gate panel 24B. The aperture A2 may also define a free end edge, the free end edge opposes a hinged edge defined by fold line 25B. The aperture A2 extends into the third divider panel 22. The portion of the aperture A2 struck from the third divider panel 22 is dimensioned to accommodate or receive the second gate panel 24B in an open condition. In this way the second gate panel 24B acts like a draw bridge spanning or crossing a space or gap between the third and second base panels 26, 20.

Figure 5:
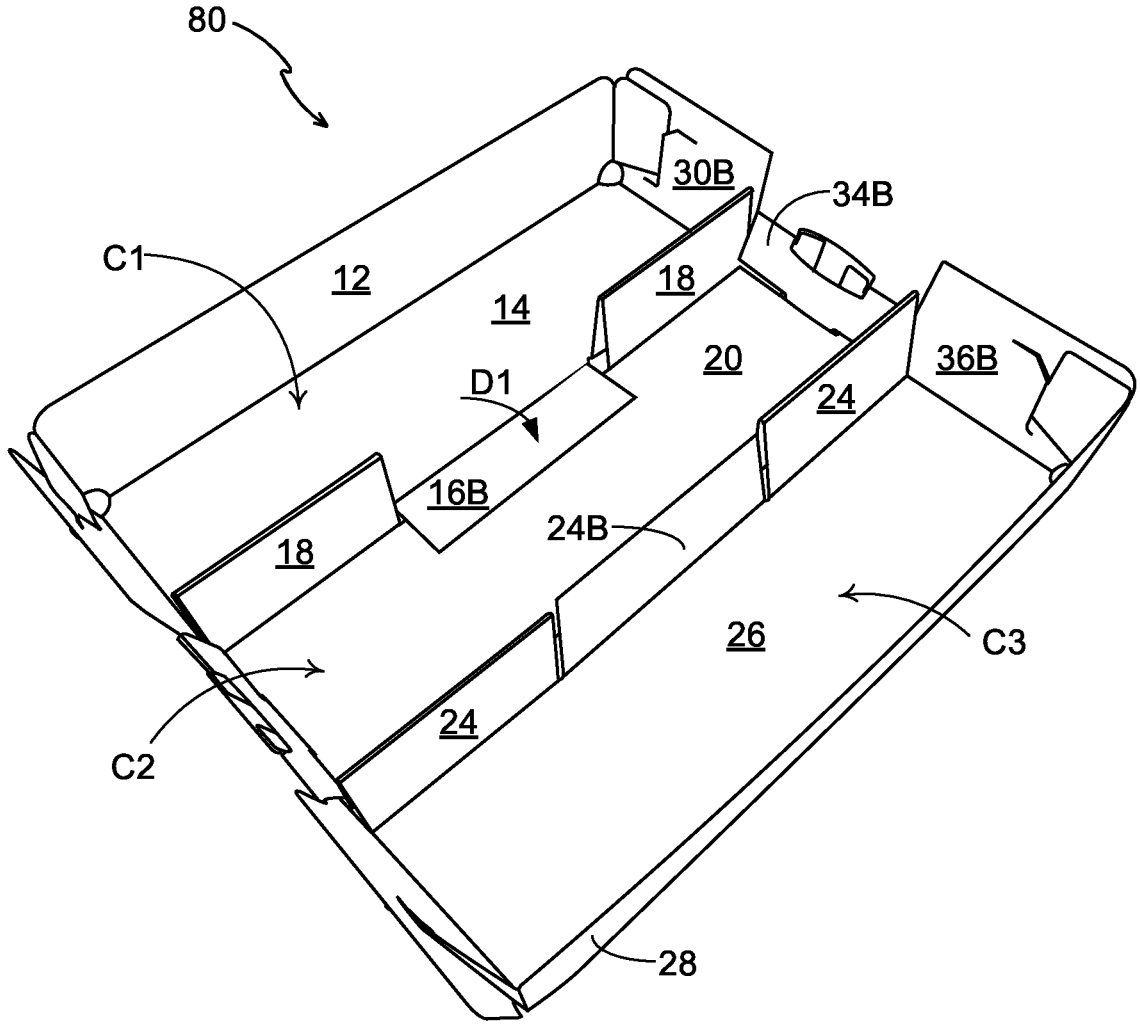
FIG. 5 is a perspective view from above of a tray formed from the blank of FIG. 1 in a second condition.

The first and second gate panel 16B, 24B are translatable or transformable between first and second positions or orientations. In FIG. 5 the first gate panel 16B has been transformed by pivoting or rotating the first gate panel 16B about the fold line 15B. Direction arrow D1 indicates folding or unfolding the first gate panel 16B with respect to the first base panel 14.

In alternative embodiments, the gate panels 16B, 24B may be defines by one or more cut lines or severance line. In some embodiments gate panels may be struck from the second or third divider panels 18, 22 and hingedly connected to the second base panel 20 in addition to or replacement of the first and second gate panels 16B, 24B. In some embodiments the first or second gate panels 16B, 24B may comprise an extension portion struck from the respective one of the second and third divider panels 18, 22 and hingedly connected to said first or second gate panel 16B, 24B.

The blank 10 includes at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 27 point (pt.) SBS board (solid bleached sulfate paperboard coated on one side, trade name Print-Kote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The blank 10 may include a coating or layer laminated to the paperboard layer. The coating or laminated layer may provide oil and grease resistance or tear resistance. It optionally includes an adhesive layer between the paperboard substrate and the laminated layer.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE). Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used. The adhesive layer may be formed of polyolefin material such as a low-density polyethylene (LDPE). The adhesive layer may be placed between the substrate and the tear resistant layer to secure the tear resistant layer to the substrate.

FIGS. 2 and 3 illustrate a package 90, the package comprises a film sealed bag 50 having a top panel or surface 54. The top panel 54 comprises a dispenser D. The dispenser D comprises a tear panel 56 defined, at least in part, by a severance line 51. In the illustrated embodiment the top panel 54, or at least part thereof comprises a two ply structure. The severance line 51 defines a first opening in an outer ply. A second opening is provided in an inner ply 60 and is defined at least in part by a second severance line 53 in the inner ply 60. The second opening may dimension smaller than the first opening. A peripheral region of the tear panel 56, provided by the outer ply is secured to a peripheral region of the inner ply 60 surrounding the second opening in the top panel 54. The peripheral region of the tear panel 56 is secured to the peripheral region of the inner ply 60. The peripheral region of the tear panel 56 may be adhesively secured to the peripheral region of the inner ply 60 using a suitable adhesive such that the tear panel 56 is separable from the top panel 54. In this way the tear panel 56 may be peeled apart from the package to create an access opening O into the interior of the film sealed bag 50. The dispenser D may comprises a tear initiation device 52. The tear initiation device 52 may take the form of a tab provided by the outer ply of the top panel 54 which is unsecured or unglued to the inner ply 60. In some embodiments the tab may be adhesively secured employing an adhesive with a lower bond strength or low tack such that the tab region of the tear panel 54 is more easily separated compared to the remainder of the tear panel 54.

FIG. 3 illustrates the package 90 in an opened condition, the dispenser D has been deployed to expose the articles A within the package 90. The articles A are loaded onto the tray 80, in the illustrated embodiment three rows of articles A are disposed in a side by side relationship within the film sealed bag 50. Articles A in the at least a portion of a central row are fully exposed. Articles A in the outer rows are at least partially concealed by marginal regions of the top panel 54.

FIGS. 4 and 5 illustrate the tray 80 in an erected condition, articles A have been omitted or removed for clarity. In FIG. 4 the gate panels 16B, 24B are shown in a closed condition. In FIG. 5 the first gate panel 16B is shown in an open condition.

The partition structure comprises an opening or gap allowing articles A to pass from one trough or chamber into an adjacent trough or chamber. A first article A in a first trough may be removed by a consumer creating a space or void in the first trough. A second article A in an adjacently disposed second trough may pass from the second trough through the opening in the partition structure into the void the first trough created upon removal of the first article A.

In the illustrated embodiment the first gate panel 16B retains or maintains the articles A in the first and second troughs when in a closed condition. In the closed condition the gate panel 16B is folded about fold line 15B to extend upwardly from the first base panel 14. When sufficient articles A have been removed from the second trough C2 the first gate panel 16B can be folded, as indicated by direction arrow D1, into an open condition. A portion of the first gate panel 16B may overly or overlap the second base panel 20. In the open condition articles A disposed in the first trough may pass into the second trough C2.

The second gate panel 24B similarly retains or maintains the articles A in the second and third troughs C2, C3 when in a closed condition and allows passage of articles A though a gap or opening in the partition structure when in an open condition.

Referring now to FIG. 6, there is shown an additional embodiment of the present disclosure. In the second illustrated embodiments like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIGS. 1 to 5 will be described in detail.

FIG. 6 illustrates a second embodiment and shows a blank 110 comprising a plurality of panels 112, 114, 116, 118, 120, 122, 124, 126, 128. The plurality of panels 112, 114, 116, 118, 120, 122, 124, 126, 128 includes a first side panel 112 hingedly connected to a first base panel 114 by a hinged connection in the form of a fold line 113. The first base panel 114 is hingedly connected to a first divider or partition panel 116 by a hinged connection in the form of a fold line 115. The first divider panel 116 is hingedly connected to a second divider panel 118 by a hinged connection in the form of a fold line 117. The second divider panel 118 is hingedly connected to a second base panel 120 by a hinged connection in the form of a fold line 119. The second base panel 120 is hingedly connected to a third divider or partition panel 122 by a hinged connection in the form of a fold line 121. The third divider panel 122 is hingedly connected to a fourth divider or partition panel 124 by a hinged connection in the form of a fold line 123. The fourth divider panel 124 is hingedly connected to a third base panel 126 by a hinged connection in the form of a fold line 125. The third base panel 126 is hingedly connected to a second side panel 128 by a hinged connection in the form of a fold line 127.

In the second illustrated embodiment a first gate panel 116B is struck from the first divider panel 116 and a second gate panel 124B is struck from the fourth divider panel 124.

Opposed side edges of the first gate panel 116B are defined by a first pair of cut lines or severance lines 161A, 161B. The first pair of cut lines or severance lines 161A, 161B may be divergently arranged with respect to each other. The first pair of cut lines or severance lines 161A, 161B may be arranged to diverge towards the first base panel 114.

A first aperture A1 is struck from the second divider panel 118 and defines an end edge of the first gate panel 116B. The first aperture A1 may be longer in a longitudinal direction than at least a portion of the first gate panel 116B. The free end edge of the first gate panel 116B is shorter than an adjacent portion of the first aperture A1.

Opposed side edges of the second gate panel 124B are defined by a second pair of cut lines or severance lines 163A, 163B. The second pair of cut lines or severance lines 163A, 163B may be divergently arranged with respect to each other. The second pair of cut lines or severance lines 163A, 163B may be arranged to diverge towards the third base panel 126.

A second aperture A2 is struck from the third divider panel 122 and defines an end edge of the second gate panel 124B. The second aperture A2 may be longer in a longitudinal direction than at least a portion of the second gate panel 124B. The free end edge of the second gate panel 124B is shorter than an adjacent portion of the second aperture A2.

The first gate panel 116B may be severably connected to the first divider panel 116. The second gate panel 124B may be severably connected to the fourth divider panel 124. In this way when the carrier is erected the first and second gate panels 116B, 124B are folded simultaneously with the respective one of the first and fourth divider panels 116, 124. The gate panel 116B, 124B can be separated from the respective one of the first and fourth divider panels 116, 124 when it is desired to open a portal in the partition structures created by the divider panels 116, 118, 122, 124.

The present disclosure provides a package 90 comprising carrier 80 having a base wall 14, 20, 26; 114, 120, 126, opposed side walls 12, 28; 112, 128 and opposed end walls to define an interior. The carrier 80 may take the form of an open topped tray. The package 90 further comprises a plurality of articles A disposed in the interior of the carrier 80. The package 90 comprises a partition structure 16/18, 22/24; 116/118, 122/124 dividing the interior into two or more chambers C1, C2, C3. The partition structure 16/18, 22/24; 116/118, 122/124 may be integral with the carrier 80.

The partition structure 16/18, 22/24; 116/118, 122/124 may comprise an opening or portal providing a passageway between two adjacently disposed chambers C1/C2, C2/C3. The opening may be defined or controlled, at least in part by, a gate panel 16B, 24B; 116B, 124B.

The gate panel 16B, 24B; 116B, 124B is translatable or transformable between a first condition and a second condition. In the first condition the gate panel 16B, 24B; 116B, 124B substantially closes the opening in the partition structure. In the second condition the portal is open such that articles may pass between the two adjacently disposed chambers.

In some embodiments, the base wall 14, 20, 26; 114, 120, 126 of the carrier may comprise a pair of spaced apart base panels 14/20, 20/26; 114/120, 120/126 and the gate panel 16B, 24B; 116B, 124B, in the second condition spans or crosses a gap between the pair of spaced apart base panels 14/20, 20/26; 114/120, 120/126.

The partition structure 16/18, 22/24; 116/118, 122/124 may couple a first base panel 14, 26; 114, 126 to a second base panel 20; 120. The partition structure 16/18, 22/24; 116/118, 122/124 may span or cross a gap between the first base panel 14, 26; 114, 126 and the second base panel 20; 120. The carrier 80 may comprise a two or more divider panels 16, 18, 22, 24; 116, 118, 122, 124 coupling the first base panel 14, 26; 114, 126 to the second base panel 20; 120. The carrier 80 may comprise a pair of divider panels 16/18, 22/24; 116/118, 122/124 coupling the first base panel 14, 26; 114, 126 to the second base panel 20; 120.

The end walls of the carrier may be formed from a first end panel 30A, 36A; 130A, 136A hinged to the first base panel 14, 26; 114, 126 and a second end panel 32A; 132A hinged to the second base panel 20; 120. The first end panel 30A, 36A; 130A, 136A is secured to the second end panel 32A; 132A in at least partial overlapping relationship such that the first base panel 14, 26; 114, 126 is spaced apart from the second base panel 20; 120.

The package may comprise a film sealed bag 50 in which the carrier 80 is disposed, the film sealed bag 50 comprises a first panel 54 having a tear panel 56 defining an access opening O for gaining access to the interior of the carrier 80. The portal in the partition structure 16/18, 22/24; 116/118, 122/124 may facilitate alignment of the articles A with the access opening O for removal from the package 90.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carrier for a package comprising:

an interior configured to receive a plurality of articles, the interior defined at least in part by:

a base wall;

opposed side walls; and opposed end walls;

a partition structure dividing the carrier into two or more chambers, wherein the partition structure comprises a portal and at least one gate panel translatable or transformable between a first position extending upwardly from the base wall closing the portal in the partition structure and a second position forming a passageway between two adjacently disposed chambers in an open condition in which the at least one gate panel is in the second position, wherein the at least one gate panel having a free upper end edge that forms part of an upper edge of the partition structure.

2. The carrier according to claim 1, wherein the base wall of the carrier comprises a first base panel and a second base panel.

3. The carrier according to claim 2, wherein the first base panel is coupled to the second base panel by the partition structure.

4. The carrier according to claim 2, wherein the first base panel is spaced apart from the second base panel by a gap.

5. The carrier according to claim 4, wherein the at least one gate panel spans the gap between the first base panel and the second base panel when in the second position.

6. The carrier according to claim 5, wherein the at least one gate panel is hingedly connected to one of the first and second base panels.

7. The carrier according to claim 2, wherein the partition structure comprises two or more divider panels interconnecting the first base panel and the second base panel.

8. The carrier according to claim 1, wherein the partition structure comprises at least two divider panels comprising a first divider panel hingedly connected to a second divider panel.

9. The carrier according to claim 8, wherein a cutaway is struck from the at least two divider panels to form the portal.

10. The carrier according to claim 8, wherein a each of the at least one gate panel is struck from at least one of the at least two divider panels.

11. The carrier of claim 1 wherein in the second position, the at least one gate panel is folded towards the base wall to open the portal in the partition structure.

12. The carrier of claim 1 wherein the partition structure comprises a cutaway for forming the portal.

13. A package comprising:

a film sealed bag; and a carrier disposed within the film sealed bag, the carrier comprising:

an interior defined at least in part by:

a base wall;

opposed side walls; and opposed end walls;

a plurality of articles disposed in the interior of the carrier;

a partition structure dividing the carrier into two or more chambers, wherein the partition structure comprises a portal and at least one gate panel translatable or transformable between a first position extending upwardly from the base wall closing the portal in the partition structure and a second position forming a passageway between two adjacently disposed chambers in an open condition in which the at least one gate panel is in the second position, wherein the at least one gate panel having a free upper end edge that forms part of an upper edge of the partition structure.

14. The package according to claim 13, wherein the film sealed bag comprises an access opening defined at least in part by a tear panel, the access opening being arranged to fully expose at least one article disposed in one of the chambers.

15. The package according to claim 14, wherein at least one article in another of the chambers is at least partially obscured by a portion of the film sealed bag adjacent to the tear panel.

16. A blank for forming a carrier, the blank comprising a plurality of panels for forming walls of the carrier, the plurality of panels including:

at least one base panel, first and second side panels, at least one first end panel for forming a first end wall of the carrier, and at least one second end panel for forming a second end wall of the carrier;

at least one divider panel for forming a partition structure dividing the carrier, in a set-up carrier condition, into two or more chambers, wherein the at least one divider panel comprises a cutaway for forming a portal in the set-up carrier, wherein the cutaway defines, at least in part, a gate panel, wherein the portal and the gate panel is configured to be translatable or transformable between a first position extending upwardly from the base panel to close the portal in the partition structure and a second position to provide a passageway between two adjacently disposed chambers, wherein the gate panel having a free upper end edge that forms part of an upper edge of the partition structure.

17. The blank according to claim 16, wherein the at least one first end panel comprises a first part of a complementary locking mechanism and the at least one second end panel comprises a second part of the complementary locking mechanism that is configured to receive at least a portion of the first part to limit movement between the first part and the second part in a locked condition.

18. The blank according to claim 16, wherein the at least one base panel comprises a first base panel and a second base panel, wherein the at least one divider panel comprises at least two foldably connected divider panels, wherein the second base panel is coupled to the first base panel by the at least two foldably connected divider panels;

wherein the at least one first end panel is hingedly connected to the first base panel and the at least one second end panel is hingedly connected to the second base panel and securable to the at least one first end panel in at least partial overlapping relationship in a set up condition;

wherein the at least two foldably connected divider panels are foldable into a face-to-face relationship to divide an interior of the set-up carrier into the two adjacently disposed chambers.

* * * * *